United States Patent [19]

Flaum

[11] 4,270,799

[45] Jun. 2, 1981

[54] MODULAR CHAIR APPARATUS

[76] Inventor: Dennis M. Flaum, 260 E. Chestnut, Chicago, Ill. 60610

[21] Appl. No.: 46,611

[22] Filed: Jun. 8, 1979

[51] Int. Cl.[3] ..... A47C 7/00

[52] U.S. Cl. ..... 297/440; 297/441; 297/445

[58] Field of Search ..... 248/188.91; 297/294, 297/419, 440, 441, 445, 447, 45, 287, 280; D6/56

[56] References Cited

U.S. PATENT DOCUMENTS

| | | | |
|---|---|---|---|
| 2,509,451 | 5/1950 | Reinholz | 297/440 X |
| 2,710,053 | 6/1955 | Hamilton | 248/188.91 X |
| 2,722,967 | 11/1955 | Reinholz | 297/447 X |
| 2,771,122 | 11/1956 | Straub | 297/441 X |

*Primary Examiner*—James T. McCall

*Attorney, Agent, or Firm*—Alter and Weiss

[57] ABSTRACT

A modular chair apparatus designed for easy home assembly comprising two frame elements and a connection bar which securely fastens together to form a modern and handsome chair. The interlocking frame elements are securely joined to each other with a frame attachment element locking the frames together. The chair may have an upholstered back and seat thereby producing a comfortable and secure seating apparatus.

6 Claims, 8 Drawing Figures

MODULAR CHAIR APPARATUS

BACKGROUND OF THE INVENTION

The present invention relates, in general, to a chair and more particularly to a modular chair apparatus that is easy to assemble as well as comfortable.

Knocked-down chair assemblies which are chair assemblies that can be assembled at home have a number of problems associated with them. Unskilled people are frequently at a loss in assembling them, especially where the apparatus consists of several integrated and complex parts.

Even where the people are able to assemble the prior complex chair assemblies, one is never sure whether they are securely fastened to achieve comfort and safety. The home-assembly industry is therefore, constantly searching for easy-to-assemble chair assemblies, ones that can be assembled by unskilled people rather than by skilled people.

Accordingly, an object of the present invention is to provide a new and unique easy-to-assemble modular chair.

Another related object of the present invention is to provide a chair apparatus comprising a few parts that fit securely together by means of interlocking without fasteners. The frame elements are joined by utilization of male and female interlocking devices that extend from and are a part of the frame elements, whereby the relative ease of assembling the frame would present no problem irregardless of the skill of the people assembling the chairs.

Another related object of the invention is to provide an easy-to-assemble upholstery apparatus which forms the seat and back of a modular chair apparatus. The upholstery apparatus, forming the seat and back as one combined piece, is securely affixed on the frame element by the use of attachment sleeves which are part of the upholstery apparatus.

Still another related object of the present invention is to provide further chair embodiments in the form of different widths, wherein key structural elements may be modularaly used in a number of different width configurations. The frame elements and upholstery apparatus are adaptable to the type and size of modular chair the user requires.

These and other objects of the invention will become readily apparent from the present disclosure.

SUMMARY OF THE INVENTION

The present invention is a modular chair apparatus which comprises an integrated frame element consisting of first and second side frame elements which are capable of being securely connected to each other by the use of a frame connection means. The frame connection means is operably associated between the first and second side frame elements. The integrated frame element is a substantially U-shaped upper portion and a substantially U-shaped base which is connected by vertical frame elements.

The chair upholstery is disposed between the first and second side frame elements and the frame connection means. Further, the chair upholstery is affixed to the first and second side frame elements and the frame connection means through the utilization of sleeve attachments.

The first side frame element comprises an upper and lower frame element attachment means which is received into the apertures on the upper portion and base portion of the second side frame elements.

The frame connection means comprises interlocking members at either of its two ends each of which is attachable to the frame element means which have apertures in the vertical frame elements for receiving the interlocking members. The interlocking members are capable of insertion into the apertures for fixedly maintaining the positions of the frame elements relative to one another.

The interlocking members of the frame connector comprise a notched attachment device which protrudes into the apertures of the frame element to lock therewithin, thereby securely positioning the frame connector within the frame elements.

The chair upholstery comprises a seat portion and back portion associated with one another and is fabricated of a cushioning pliable textile material to provide comfort for the user.

Further, the chair upholstery comprises two substantially cylindrically looped elements and two sleeve attachments for removably attaching the chair upholstery to the frame elements. The first substantially cylindrically looped element affixes to the front bottom surface of the seat portion for attachment to the frame connector, while the second substantially cylindrically looped element affixs to the upper back side of the back portion for attachment to the U-shaped upper portion of the frame element. The first sleeve attachment connects to one side of the upper U-shaped portion, while the second sleeve attachment connects to the second side of the upper U-shaped portion. Each sleeve attachment is connected to the opposite side of the seat portion through one of a pair of arm enclosure panels. The arm enclosure panels may include pockets to provide a receptacle for reading materials.

The invention further contemplates the use of different widths of frame elements and frame connection means to provide a modular chair apparatus for more than one user. In this embodiment, there is a vertical frame connection means operably disposed between the U-shaped upper portion and base portion of the integrated frame element means. The vertical frame connection means also utilizes interlocking members which are received into apertures on the U-shaped upper portion and base portion of the frame element means.

The above-mentioned and other features and objects of this invention and the manner of obtaining them will become more apparent and the invention itself will be best understood with reference to the following description of the embodiments of the invention, taken in connection with the accompanying drawings, wherein:

DETAILED DESCRIPTION

Figure 1:
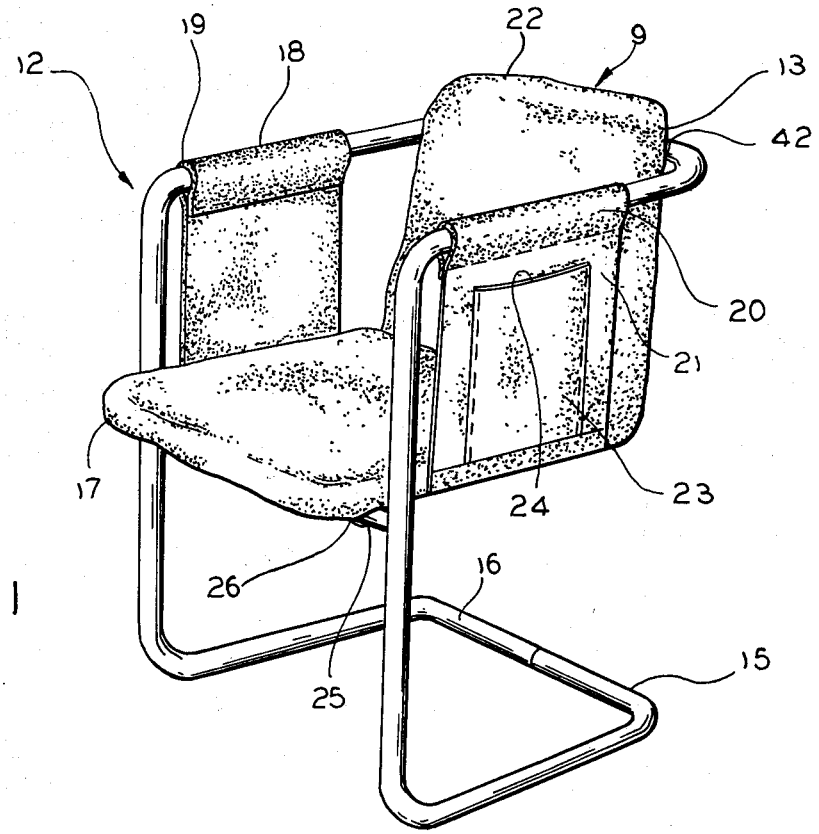
FIG. 1 of the drawings is a pictorial view of the modular chair with upholstery.

While this invention is susceptible of embodiment in many different forms, there is shown in the drawings and will herein be described in detail, two specific embodiments, with the understanding that the present disclosure is to be considered as an exemplification of the principles of the invention and is not intended to limit the invention to the embodied embodiments illustrated.

The modular chair apparatus 9 as shown in FIG. 1, comprises first and second side frame element means 15, 16 which join together to form integrated frame element 12 and chair upholstery means 22. The chair upholstery means 22 comprises seat portion 17 and back portion 13, which when assembled, rests on frame connection means 25 extending horizontally between first and second side frame element means 15, 16, respectively.

The chair upholstery means 22 is connected to frame element 12 by the use of chair upholstery sleeve attachments 18, 20. Chair upholstery sleeve attachment means 18, 20 are slidably associated with the U-shaped upper portion 73 of the integrated frame element 12.

Figure 4:
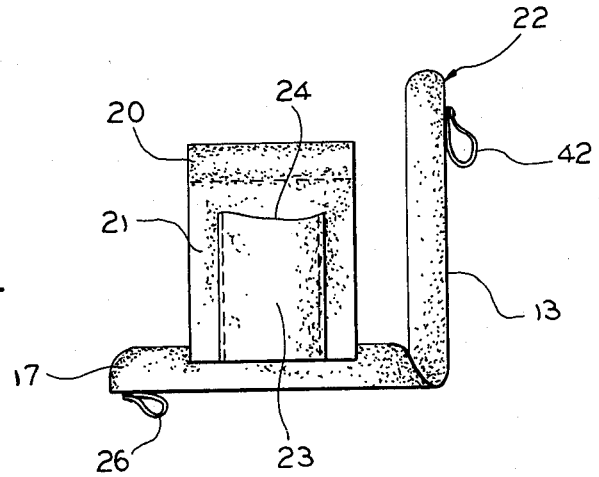
FIG. 4 is a side elevated view of the chair upholstery means with sleeve attachment means.

As seen further in FIG. 1, first substantially cylindrical looped element 26 is removably attached to frame connector 25, while second substantially cylindrically looped element 42 is removably attached to U-shaped upper portion 73 of the frame element 12, best illustrated in FIG. 4.

Arm enclosure panels 19, 21, which are a part of chair upholstery sleeve attachments 18, 20, are connected to one another and pass under seat portion 17 to provide further support to a user. Arm enclosure panel 21 further contains pocket means 23 with opening 24 into which articles may be placed.

Figure 2:
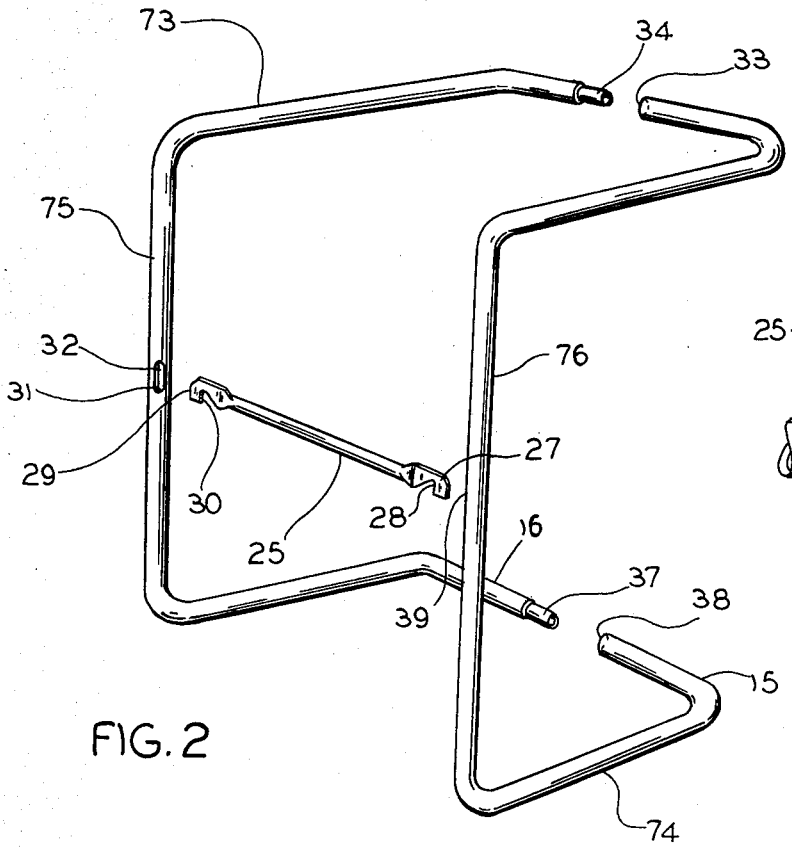
FIG. 2 is a pictorial view of the frame element means of the modular chair showing the placement of the frame connection means.

First and second side frame element means 15, 16 are assembled to form frame element 12 by the use of upper and lower frame element attachment means, as illustrated in FIG. 2. The frame element attachment means comprises telescopic protrusions 34, 37 located on second side frame element means 16 which securely and slidably fit into upper and lower apertures 33, 38 of first side frame element means 15.

Further illustrated in FIG. 2 is the substantially U-shaped upper portion 73 and base portion 74 connected by vertical frame elements 75, 76 to form integrated frame element 12.

Frame connector 25, as shown in FIG. 2, is received by first and second side frame element means 15, 16. Frame connector 25 comprises inter-locking members 27, 29 at either of its two ends, each of which is respectively attachable to said first and second side frame element means 15, 16 by the use of apertures in each of the vertical frame elements 75, 76. Each aperture 32, 39 of the vertical frame elements 75, 76 receives notched attachment device 28, 30 of frame connector 25, best seen in FIG. 3.

Figure 3:
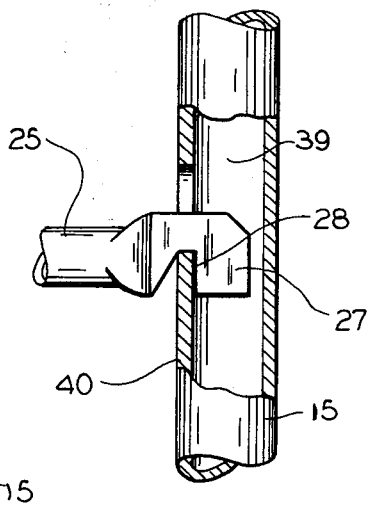
FIG. 3 is a partial-sectional view illustrating interlocking members which connect the frame element means.

FIG. 3 is a partial sectional view of first side frame element means 15 illustrating the locking mechanism of the invention. Interlocking member 27 of frame connector 25 is received into aperture 39 on first side frame element means 15. The notched attachment device 28 of interlocking member 27 rests on lower edge 40 of aperture 39 which forms securely assembled frame element 12.

In FIG. 4 the chair upholsetry means 22 is shown with seat portion 17 and back portion 13 assembled illustrating the position of arm enclosure panel 21 having pocket means 23. Further illustrated are first and second substantially cylindrically looped elements 26, 42 which when assembled, removably attach to frame element 12.

Figure 5:
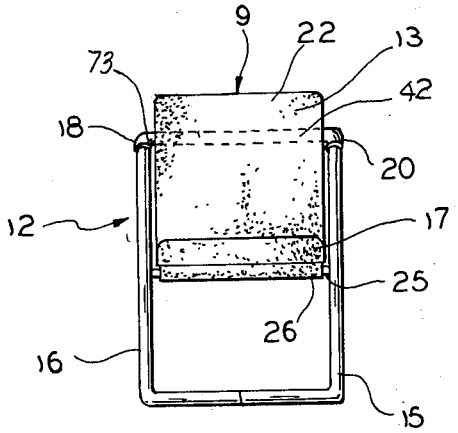
FIG. 5 is a front elevational view of the modular chair apparatus wherein the chair upholstery means is assembled with the frame element means.

The assembled chair apparatus 9 is illustrated in a front elevational view in FIG. 5. Seat portion 17 is shown connected to frame connector 25 by the use of first substantially cylindrically looped element 26. Further shown in FIG. 5 is back portion 13 connected to U-shaped upper portion 73 of frame element 12 by the use of second substantially cylindrically looped element 42.

Figure 6:
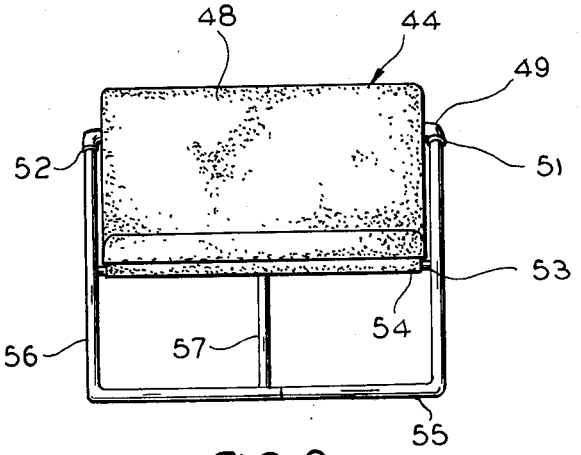
FIG. 6 is a front elevational view of different embodiments of the invention wherein there is a vertical frame connection means securely affixed to the first side frame element means.

FIG. 6 illustrates another form of the invention 44 which has an increased width by the utilization of wider chair upholstery means 48 and lengthened first and second side frame element means 55, 56. Further, the embodiment utilizes a vertical frame connector means 57, in addition to horizontal frame connector 53, which connected to U-shaped upper portion and base portion of frame element means 56. Chair upholstery means 48 connects to assembled frame element 49 by the use of sleeve attachment 51, 52 and substantially cylindrical looped element 54.

Figure 7:
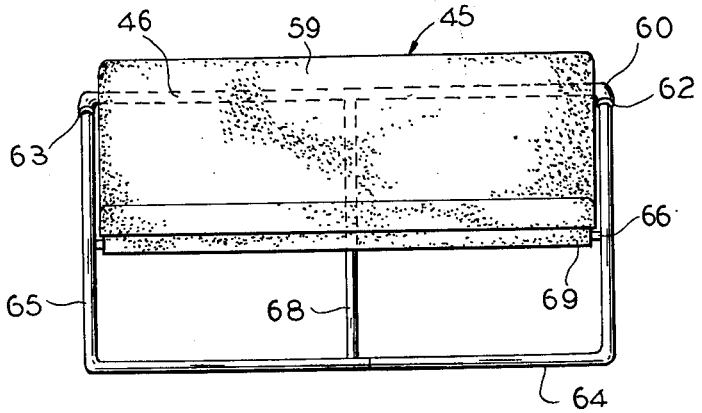
FIG. 7 is a front elevational view of another embodiment of the modular chair apparatus illustrating the different widths of the chair upholstery means.

Beyond the above embodiments, the invention can include a wider chair upholstery means 59 such as seen in FIG. 7 where there are extended first and second side frame element means 64, 65 providing seating for more than one user. Also shown in this embodiment is the utilization of vertical frame connector 68 and horizontal frame connector 66 which securely fastens first and second side frame element means 64, 65 to form integrated frame element 60. The locking mechanism of vertical frame connection means 68 is best illustrated in FIG. 3: sleeve attachments 62, 63 and substantially cylindrically looped elements 46, 69 are connected to integrated frame element 60.

Figure 8:
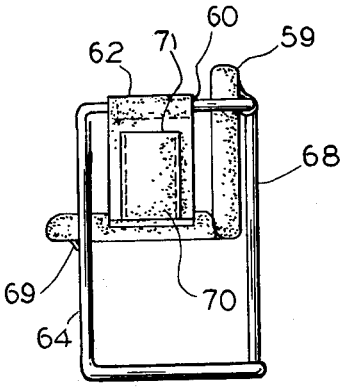
FIG. 8 is a side elevational view of the embodiment in FIG. 7 of the modular chair apparatus illustrating the arm enclosure panel of the chair upholstery means with pocket for containing reading material.

Illustrated in FIG. 8 is a side elevational view of the embodiment in FIG. 7 showing the vertical frame connector 68 associated the U-shaped upper portion to the U-shaped base portion of frame element 60 which provides additional support for a user. Pocket means 70 with aperture 71 is shown on sleeve attachment 62 to give the furniture means for storage.

The foregoing description and drawings merely explain and illustrate the invention and the invention is not limited thereto, except insofar as the appended claims are so limited, and those skilled in the art have the disclosure before them will be able to make modifications and variations therein, without departing from the scope of the invention.

What is claimed is:

1. A modular disassemblable chair apparatus comprising:

an integrated tubular frame, said frame having an independent first side frame member and an independent second side frame member assemblable one to the other to form said frame, each said frame member, having a horizontal base seqment, an upwardly extending leg segment integral with said base portion, an arm segment integral with and extending rearward from said leg segment, and a back segment integral with said arm segment and extending generally coplanar with said arm segment;

said frame, when assembled, having said leg segments oppositely disposed one from the other, and said arm segments oppositely disposed one from the other;

a frame brace extending generally horizontally between said first and second leg segments;

means to removably secure said brace to said leg segments; and a chair upholstery assembly, said upholstery assembly having a generally quadrilateral seat portion having four edges, a pair of side wing segments extending from an opposed pair of said edges, a seat back segment extending from a third of said edges; and means terminating each said wing segment and integral with said wing segment to suspend each said wing segments from one said arm segment of said frame, means to secure said back segment of said seat assembly to said back frame segment, and means to removably secure said seat portion to said frame brace proximate the fourth of said edges.

2. The apparatus as recited in claim 1 wherein said suspension means for said wing segments comprises a sleeve integral with each said wing segment and formed proximate the outermost extremity thereof.

3. The apparatus as recited in claim 1 wherein said seat attaching and said back attaching means comprise loop segments having two ends, one said end attached to said seat portion or said back portion, the remaining said end attachable to and detachable from said seat portion or said back portion respectively.

4. The apparatus as recited in claim 1 wherein said first and second frame members are telescopically joined one to the other at said base segments and said back segments.

5. The apparatus as recited in claim 1 wherein said attachment means for said frame brace includes a pair of slots formed in said leg segments of said frame whereby said slots are horizontally oppositely disposed, and means fashioned at the ends of said frame brace shaped to extend partially into each said leg portion and engage the inner surface of said leg segment and the lowermost surface of said slot.

6. The apparatus as recited in claim 1 wherein said frame includes a vertically extending back frame brace, said back frame brace removably attachable to said frame at said back segment and said base segment.

* * * * *